US008776830B2

(12) United States Patent
Chen et al.

(10) Patent No.: US 8,776,830 B2
(45) Date of Patent: Jul. 15, 2014

(54) MATERIAL TRANSPORT APPARATUS AND METHOD

(76) Inventors: Walter Chen, Oakland, CA (US); C. K. Hari Dharan, Berkeley, CA (US)

( * ) Notice: Subject to any disclaimer, the term of this patent is extended or adjusted under 35 U.S.C. 154(b) by 588 days.

(21) Appl. No.: 13/156,741

(22) Filed: Jun. 9, 2011

(65) Prior Publication Data

US 2012/0312376 A1 Dec. 13, 2012

(51) Int. Cl.
*F04F 1/06* (2006.01)

(52) U.S. Cl.
USPC ..... 137/830; 137/806; 4/491; 405/79

(58) Field of Classification Search
USPC ..... 137/806, 826, 814, 822, 819, 827, 829, 137/830, 831; 4/491; 416/64; 405/79
See application file for complete search history.

(56) References Cited

U.S. PATENT DOCUMENTS 6,412,354 B1 * 7/2002 Birchak et al. ..... 73/861.356
7,326,001 B2 * 2/2008 McFarland ..... 405/79

* cited by examiner

*Primary Examiner* — Craig Schneider
(74) *Attorney, Agent, or Firm* — Steven R. Vosen

(57) ABSTRACT

An invention for transporting material is described. The material, which may be or include a liquid or particles, be transported floats on and flows on a more dense fluid. Standing waves may be induced in the more dense fluid, and devices are provided to either force the transported fluid in a direction, or to prevent the transported fluid from flowing in a direction counter to the flow direction. The inventive apparatus and method have the ability to transport fluids long distances with much less frictional losses than convention technology.

30 Claims, 7 Drawing Sheets

10
20
12
B

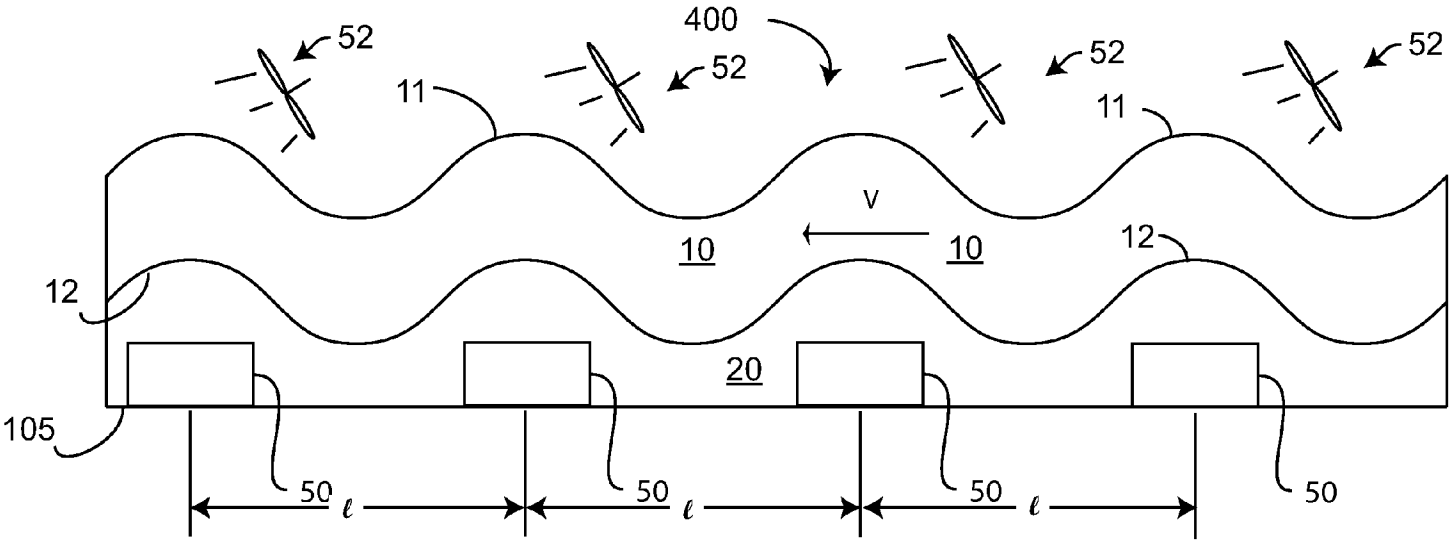
FIG. 4A
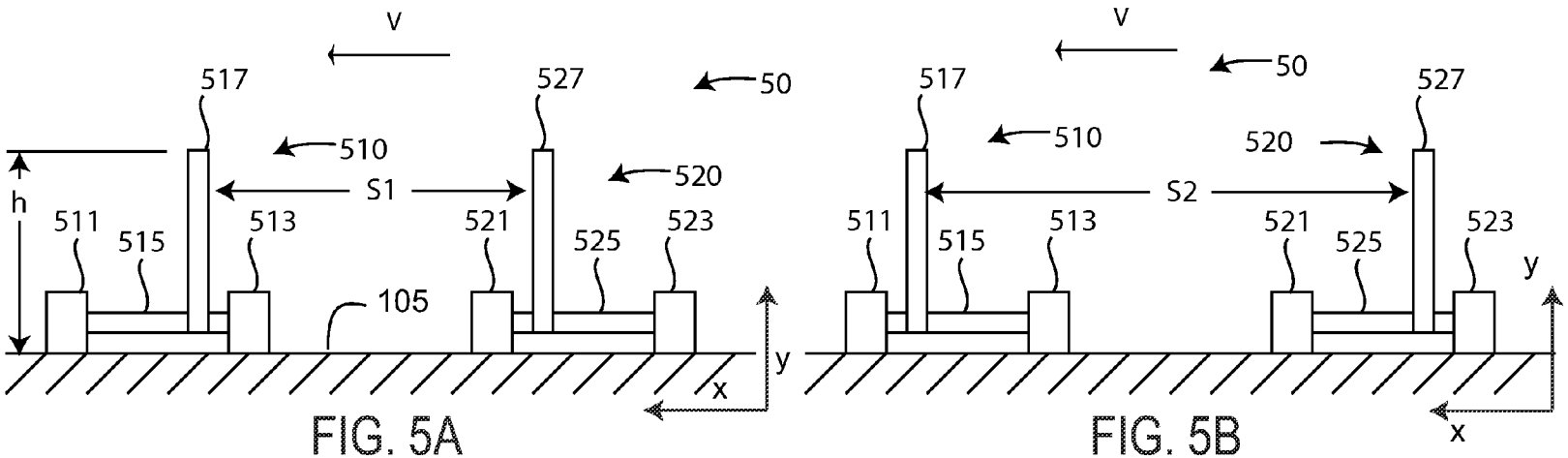
FIG. 5A
FIG. 5B

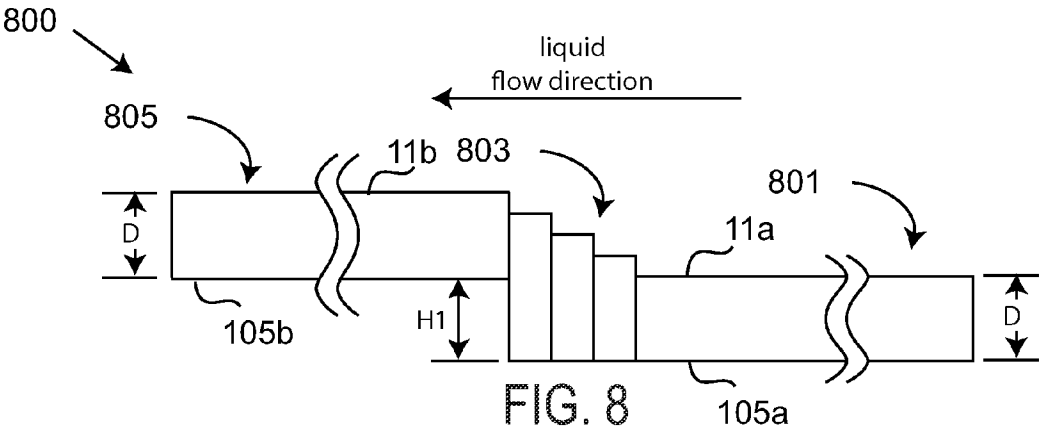
FIG. 8
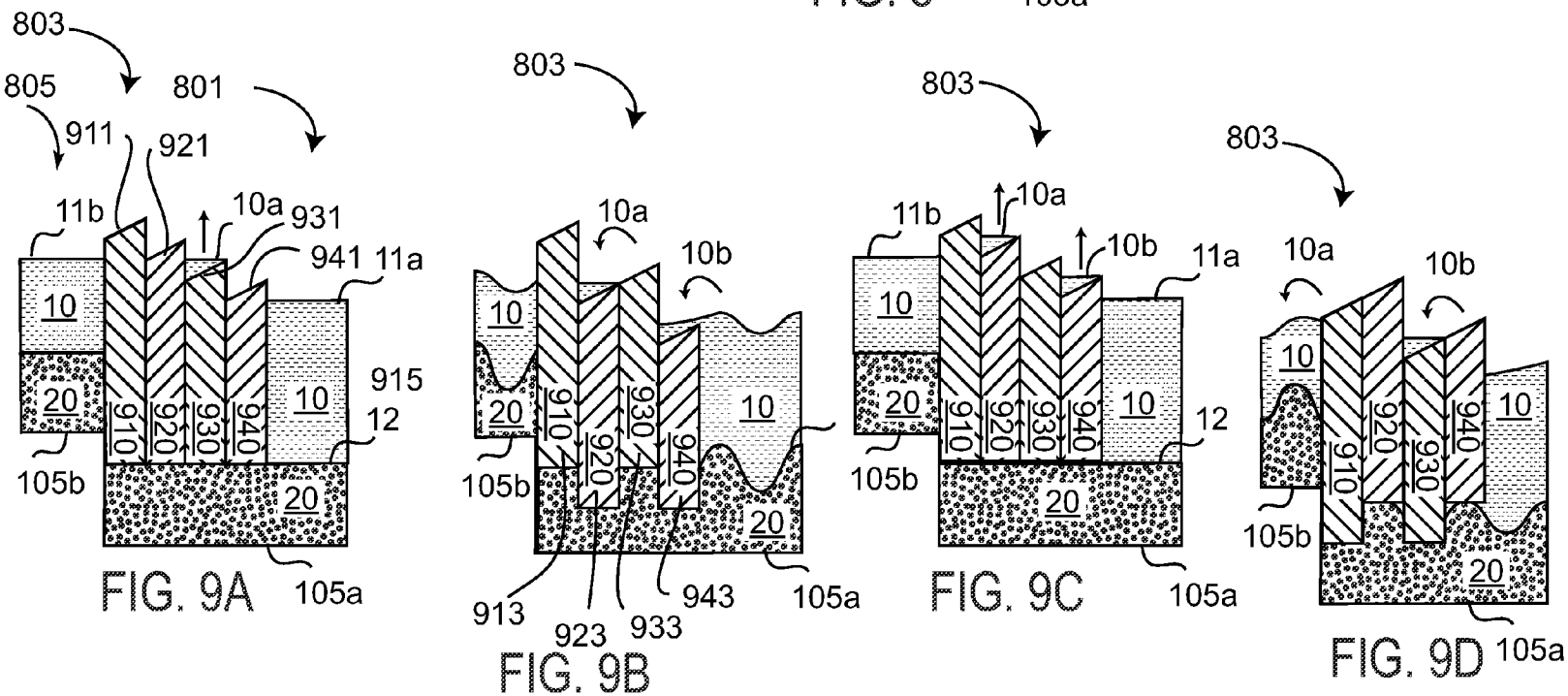
FIG. 9A
FIG. 9B
FIG. 9C
FIG. 9D

MATERIAL TRANSPORT APPARATUS AND METHOD

BACKGROUND OF THE INVENTION

1. Field of the Invention

The present invention generally relates to apparatus and methods for transporting materials, which may include fluids, and more particularly to a method and system for efficiently transporting fluids over long distances.

2. Discussion of the Background

The transport of fluids, such as water or oil, over long distances may be accomplished by shipping or by transport through a dedicated fixed system of pipes or conduits. While the use of a conduits or pipe is effective, this technique has several problems. First, the fluid experiences drag on walls of the conduit, requiring a large amount of energy to overcome frictional losses. In addition, if the system relies on gravity to provide flow, then it is also necessary to provide a consistent slope to the system over long distances.

There is a need in the art for a method and apparatus that permits the more efficient transport of material over large distances. Such a method and apparatus should be simple to construct and operate, consume less power than conventional conduits or pipes, and be less affected by the slope of the ground on which the conduit or pipes rest.

BRIEF SUMMARY OF THE INVENTION

The present invention overcomes the disadvantages of prior art by providing an apparatus and method wherein materials are transported with less frictional losses. Thus, for example, a transported fluid floats on a denser fluid. The denser fluid oscillates with no net motion, while a flow is induced in the transported fluid.

In one embodiment, an apparatus is provided to accept two or more fluids. The two or more fluids include a first fluid, less dense fluid, to be transported and a second, denser fluid that remains stationary. The apparatus includes: a channel to accept the two or more fluids; a first means to produce periodic standing waves one fluid; and a second means to induce a net motion of the less dense fluid in the flow direction.

In another embodiment, a method is provided to accept one or more fluids and transport a first fluid of the one or more accepted fluids in a flow direction. The method includes: accepting one or more fluids in a channel; imparting a periodic standing wave to the accepted fluids, where said standing wave is generally aligned with the flow direction; and providing means to inhibit the flow of the accepted first fluid in a direction counter to said flow direction.

These features together with the various ancillary provisions and features which will become apparent to those skilled in the art from the following detailed description, are attained by the fluid transporting method and device of the present invention, preferred embodiments thereof being shown with reference to the accompanying drawings, by way of example only, wherein:

BRIEF DESCRIPTION OF THE SEVERAL VIEWS OF THE DRAWING

FIG. 4A is a side view illustrating a second embodiment of an apparatus for transporting a fluid;

FIGS. 5A and 5B are side views of an embodiment of an oscillatory device;

FIG. 8 is a side view illustrating a fifth embodiment of an apparatus for transporting a fluid; and FIGS. 9A, 9B, 9C, and 9D are four sequential side views illustrating one embodiment of the apparatus of FIG. 8.

Reference symbols are used in the Figures to indicate certain components, aspects or features shown therein, with reference symbols common to more than one Figure indicating like components, aspects or features shown therein.

DETAILED DESCRIPTION OF THE INVENTION

In general, embodiments are presented of an apparatus and method for transporting material across long distances. The material may be, for example and without limitation, a fluid, such as a liquid, or may be a slurry or suspension that contains particles suspended or floating on the liquid, thereby enabling transport of solid particles as well. In general, such particles must have a density less than or equal to the transporting fluid. Solid particles themselves can consist of encapsulated third phases, for example, silica or polymer microballoons containing other fluids or particles.

Certain embodiments provide a channel or other conduit that induces longitudinal movement of at least one fluid along the length of the channel. In certain other embodiments, for example and without limitation, a transported fluid floats on a fluid within a channel. The fluid may be deformed by oscillatory motion as a standing wave, and means may be provided to induce longitudinal movement transported fluid perpendicular to the channel width.

Figure 1:
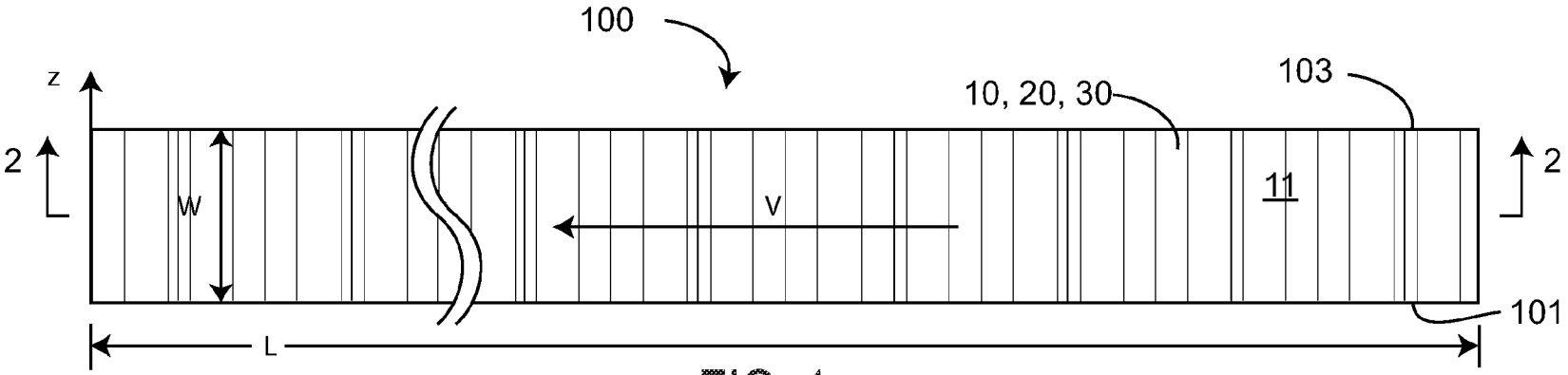
FIGS. 1 and 2 are top and side views, respectively, of one embodiment of a material transport apparatus.
Figure 2:
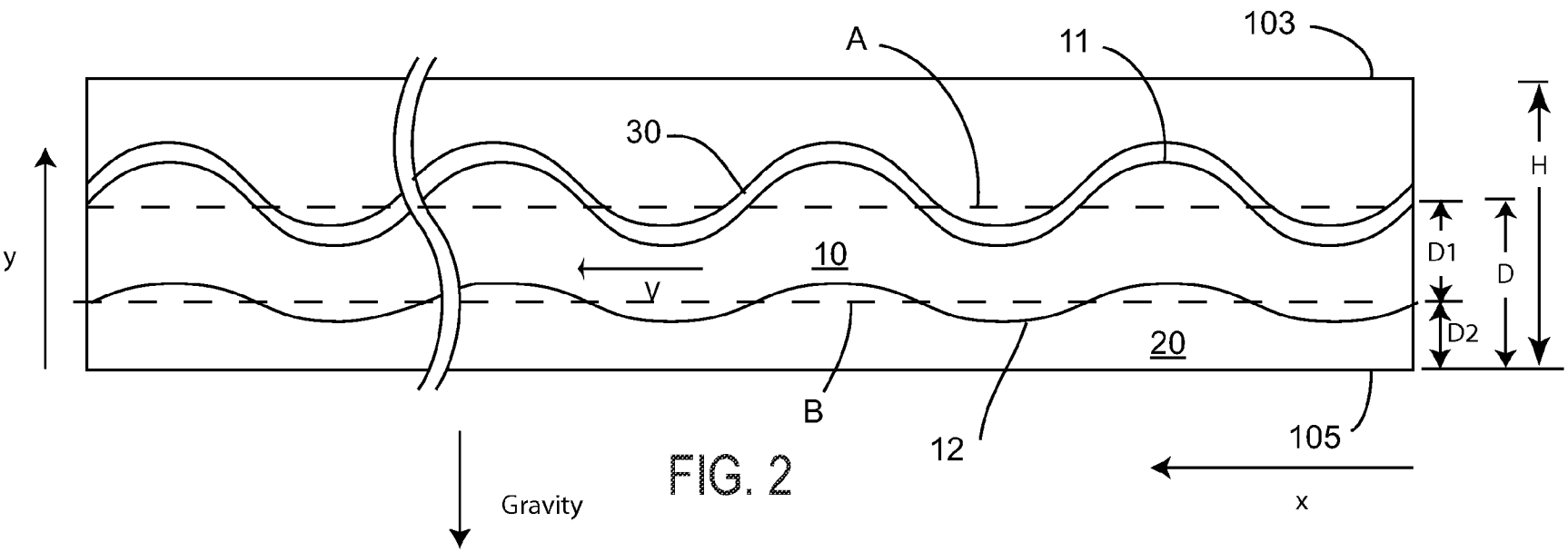
Figures 3A, 3B, 3C, 3D:
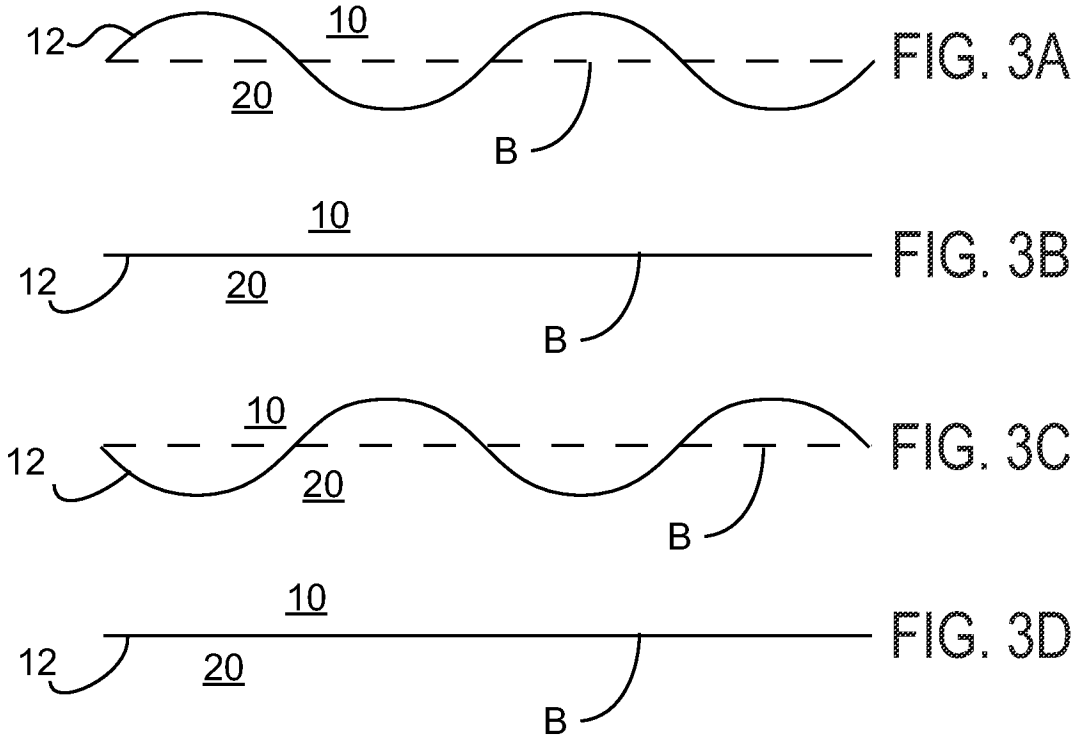
FIGS. 3A, 3B, 3C, and 3D are sequential side views of an embodiment illustrating the up and down motion of the fluid.

FIGS. 1 and 2 are general schematic representations of embodiments of the invention, where FIG. 1 is a top view and FIG. 2 is a side view 2-2 of a material transport apparatus channel 100. Channel 100 is adapted to contain one or more fluids, illustrated for example as fluids 10, 20, and 30, which do not form part of the present invention. Channel 100 may include one or more devices (not shown) within fluid 10, 20, or 30 to facilitate the flow of fluid 10 in the channel. The cross-section of channel 100 has a depth along a "y" axis and a width along a "z" axis. Channel 100 also has a length perpendicular to the cross-sectional area and having associated "x" direction. As shown in FIGS. 1 and 2, channel 100 has channel sides 101 and 103 with height H and length L, and a channel bottom 105. In general, fluid 10 moves in a direction from x=0 to x=L. It is understood that fluid 10 may be provided from channel 100 at x=0 and extracted from the channel at x=L.

In one embodiment, channel 100 has a rectangular cross-section of width W and a height H. Alternatively, channel 100 may some curvature along its length. Channel 100 is approximately horizontal.

Channel 100 may be used to transport a fluid, such as fluid 10, in a direction indicated by an arrow V. A second, denser fluid 20 is relatively stationary compared to fluid 10. Thus for example, a fluid 10 to be transported is shown as having a fluid upper surface 11 and a lower surface 12, which is also the upper surface of fluid 20.

Channel 100 may also be used to transport particles. Thus, for example and without limitation, the fluid 10 may include particles of neutral density in the first fluid, or of a density less than that of the first fluid, thereby enabling transport of particles with the net flow of the first fluid. The particles themselves may consist of encapsulated third phases such as other liquids or cargo of various materials and devices. For example, such particles may be silica or polymer microballoons containing other fluids or materials or devices.

In several embodiments, surface 11 has a wavelike structure about an average height A, and surface 12 has a wavelike structure about an average B. Average surfaces A and B are horizontal. The combined average depth of fluids 10 and 20 is shown as depth D, with fluid 10 having an average depth D1 and fluid 20 having an average depth D2 and may bound on the bottom by channel bottom 105. Fluid upper surface 11 may be a free surface, bound by air, or, alternatively, as shown optionally in FIGS. 1 and 2, by a lighter fluid 30 that floats on fluid 10.

An average longitudinal motion (flow) of fluid 10 is induced in the x direction, at least in part, by the repeated up-and-down motion of the bottom, or lower surface 12, of the fluid. As one example, FIGS. 3A, 3B, 3C, and 3D are sequential side views of an embodiment illustrating the up and down motion of the fluid, showing the displacement of fluid lower surface 12 at four sequential times during a periodic cycle. As described subsequently, embodiments of the present invention induce a periodic motion in the fluid lower surface 12 about an average B. In response to the motion of lower surface 12, fluid upper surface 11 oscillates about an average A. Under the proper circumstance, the oscillations of surfaces 11 and 12 result in a net flow of fluid 10 perpendicular to the oscillations, in the x direction.

While fluid 10 has a net flow in the x direction, fluid 20 has little or no net flow in the x direction. As described in several of the embodiments, fluid 20 executes a substantially stationary oscillatory motion which perturbs surface 12. Thus fluid 10 is transported over fluid 20.

FIG. 4A is a side view of a second embodiment channel 400 of the material transport apparatus. Channel 400 is generally similar to channel 100, and may include elements or features that may be present in channel 100, except as explicitly stated.

Channel 400 includes a plurality of oscillatory devices 50. Each oscillatory device 50 extends along the width W, and is located at regular intervals l with fluid 20. Channel 400 is generally similar to channel 100, except as where explicitly noted. As illustrated in FIGS. 6 and 7, devices 50 produce waves in fluid 10 having a wavelength λ, which is equal to length l.

Oscillatory device 50 may include, for example and without limitation, one or more vertical, oscillatory plates that extend upwards from the channel bottom. FIGS. 5A and 5B are side views of an embodiment of an oscillatory device 50, illustrating two positions of the oscillatory device. Each oscillatory device 50 includes a first device 510 and a second device 520. Each device 510, 520 includes a plate 517, 527, respectively, extending a height h above channel bottom 105 and which spans width W of channel 400. Plate 517 is coupled to bottom 105 through a linkage 515 connected to bottom mounted motors 511, 513. Plate 527 is coupled to bottom 105 through a linkage 525 connected to bottom mounted motors 521, 523. Motors 511, 513, 521, 513 move plates 517, 527 between a spacing S1 and S2, as indicated in FIGS. 5A and 5B. The motion of plates 517, 527 between spacing 51 and S2 disturbs the fluid in which it is immersed, resulting in an up and down wave action, as in FIGS. 3A-C, where the waves gradually build up by resonance. The device performs vigorous action to build the wave, and then settles into small gentle motion to sustain the waves.

As examples, which are not meant to limit the scope of the present invention, the average depth of fluid 20, D2, may be 8 feet, the height D1 may be 2 feet, the distance between each plate 517, 527 is, on average, 12 feet, with S1=8 feet and S2=16 feet, resulting in a length l of 40 feet.

FIG. 4A also illustrates alternative additional devices 52. Devices 52 have a spacing l and direct air flow in the direction V. Devices 52 may be jet of air that direct air to provide surface 11 with a force on the crest of surface 11 that forces it slightly ahead of that of surface 12. In this way, flow of fluid 10 is induced to the next standing wave during each oscillatory period, and there is a net movement of fluid in the direction V during each cycle. Fluid 20 remains essentially stationary, having little or no net motion in the x direction.

Figure 4B:
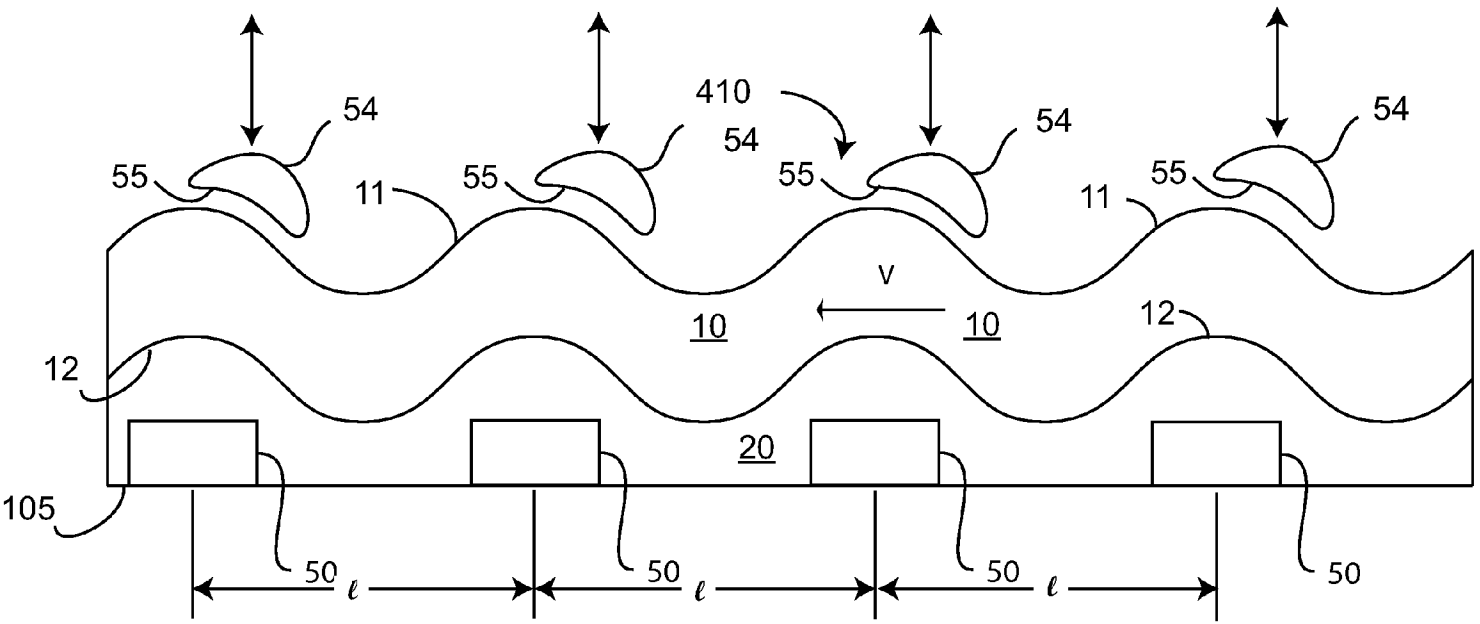
FIG. 4B is a side view illustrating an alternative second embodiment of an apparatus for transporting a fluid.

FIG. 4B is a side view of an alternative second embodiment channel 410. Channel 410 is generally similar to channels 100 and 400, and may include elements or features that may be present in channels 100 or 410, except as explicitly stated.

Channel 410 includes devices 54 that are placed at regular intervals l along the channel. Devices 54, each having a bottom surface 55 may be fixed or may move up and down, as indicated by the vertical double arrows, to coincide with the rising surface 11 to urge fluid 10 downstream. Alternatively, devices 54 could descend onto the top surface of the fluid 10 at ⅛ of each cycle before nearby peaks of fluid 20 forms.

Figure 6A:
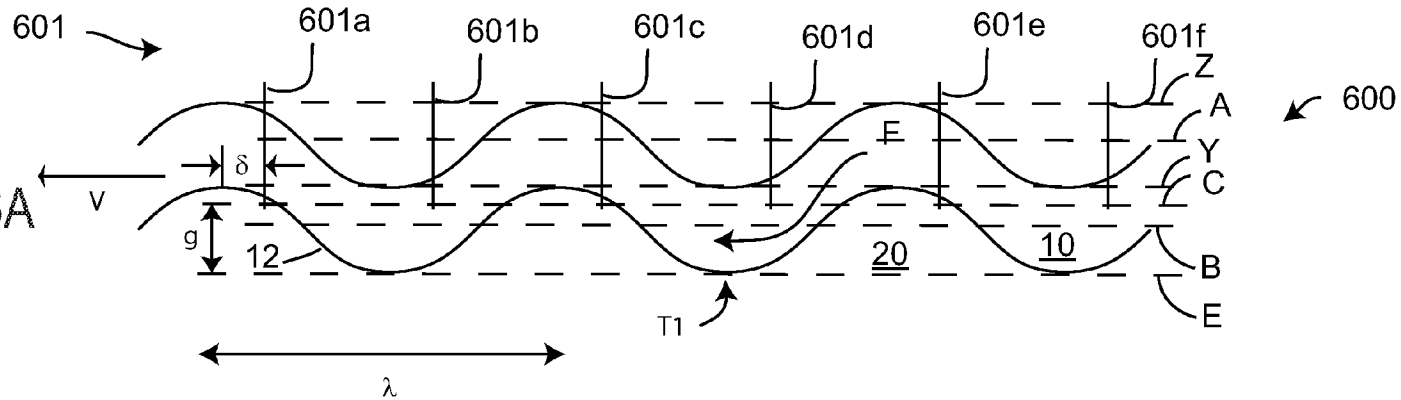
FIGS. 6A, 6B, and 6C are side views illustrating a third embodiment of an apparatus for transporting a fluid.
Figure 6B:
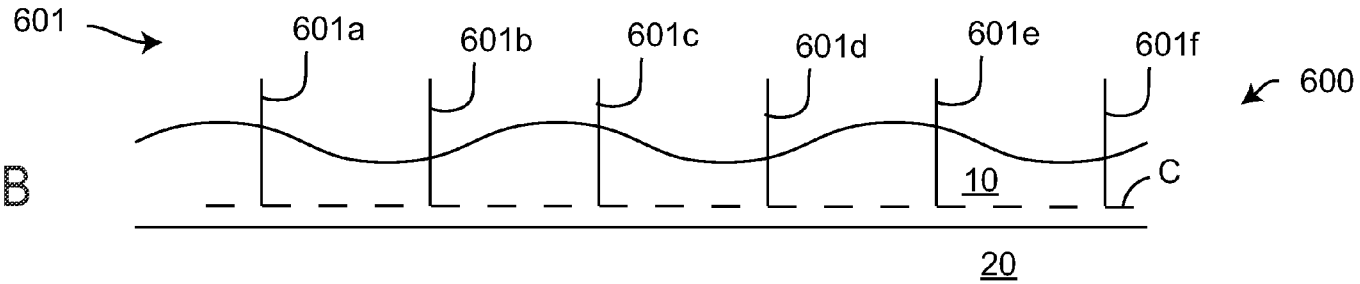
Figure 6C:
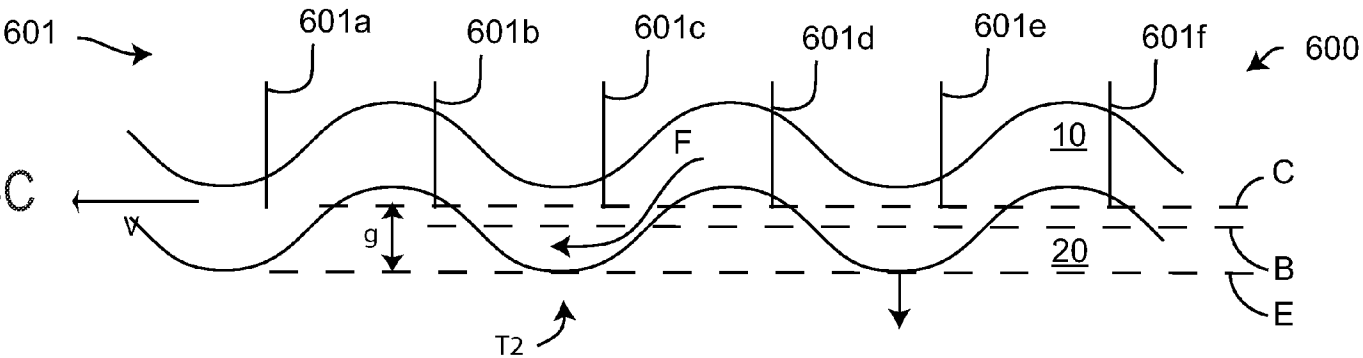

FIGS. 6A, 6B, and 6C are side views illustrating a third embodiment of a channel 600 for transporting a fluid. Channel 600 is generally similar to channels 100 or 400, and may include elements or features that may be present in channel 100 or 400, except as explicitly stated.

More specifically, FIGS. 6A, 6B, and 6C are illustrations of a portion of channel 600 at three sequential times during a cycle of period T of standing waves in fluid 10, where FIG. 6A is at time t=0, FIG. 6B at time t=T/4 and FIG. 6C at time t=T/2.

Channel 600 includes a plurality of barriers 601, several of which are individually labeled 601*a-f*. Each barrier 601 extends the width W of channel 600 and may be support at sides 101, 103. Each barrier 601 extends down to the same location C in the channel. The location C is above the average position B of surface 12, and thus protrudes fully into fluid 10 at certain portions of a standing wave cycle and does not protrude fully into fluid 10 at other times.

Individual barriers 601 are located at half-wave locations, spaced by l/2, for example. Further, barriers 601 are located at positions slightly "upstream" of the peak/trough location by a distance δ, i.e. just before each crest.

As fluid 10 oscillates between curved and flat, as indicated in FIGS. 6A-6C, surface 12 drops below some barriers 601, permitting the fluid to flow, as indicated by arrow F during each half cycle, providing a net flow of fluid 10. Specifically, due to the gap g between surface 12 and barrier 601, fluid 10 may collect in troughs of surface 12 between alternate barriers 601. Thus, for example, FIG. 6A shows that some barriers, such as barriers 601*a*, 601*c*, and 601*e*, extend through fluid 10 and thus prevent backflow past these barriers. Some barriers, such as barriers 601*b*, 601*d*, and 601*f*, have some space below location C through which fluid 10 may flow. As a result of the gap g, some net flow F of fluid 10 may flow and collect in a trough, such as trough T1.

As surface 12 recedes, as in FIG. 6B, there may be some backflow of fluid 10. In FIG. 6C, fluid 20 crests and contacts near other alternate barriers 601, causing a net flow of fluid 10. Thus, for example, the fluid in trough T1 may advance to the downstream trough T2. The repetition of this motion induces an average flow of fluid 10.

As one illustration of the dimensions of fluid in channel 600, FIG. 6A indicates the maximum height of fluid 10 as plane Z, the average height of fluid 10 as plane A, the minimum height of fluid 10 (and the maximum height of fluid 20) as plane Y, the average height of fluid 20 as plane B, and the minimum height of fluid 20 as plane E. The distance from A to Z may be, for example and without limitation approximately 2 feet, the distance from B to Y may be, for example and without limitation 3 feet, the distance from C to B may be, for example and without limitation, 1 to 3 feet, so that the gap g between C and E is from 4 to 6 feet, the distance l may be approximately 40 feet, and the distance δ may be 2.5 feet.

Figure 7D:
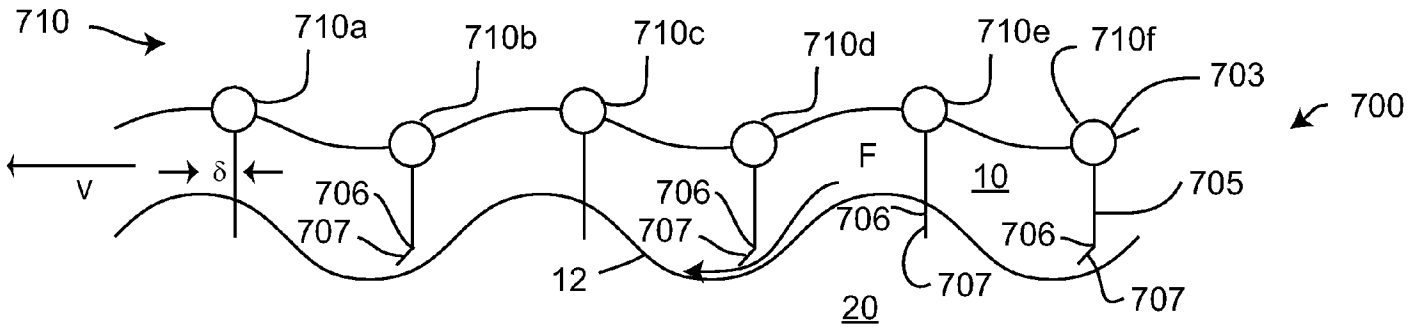
FIG. 7D is a side view illustrating an alternative embodiment fourth embodiment of an apparatus for transporting a fluid.
Figure 7A:
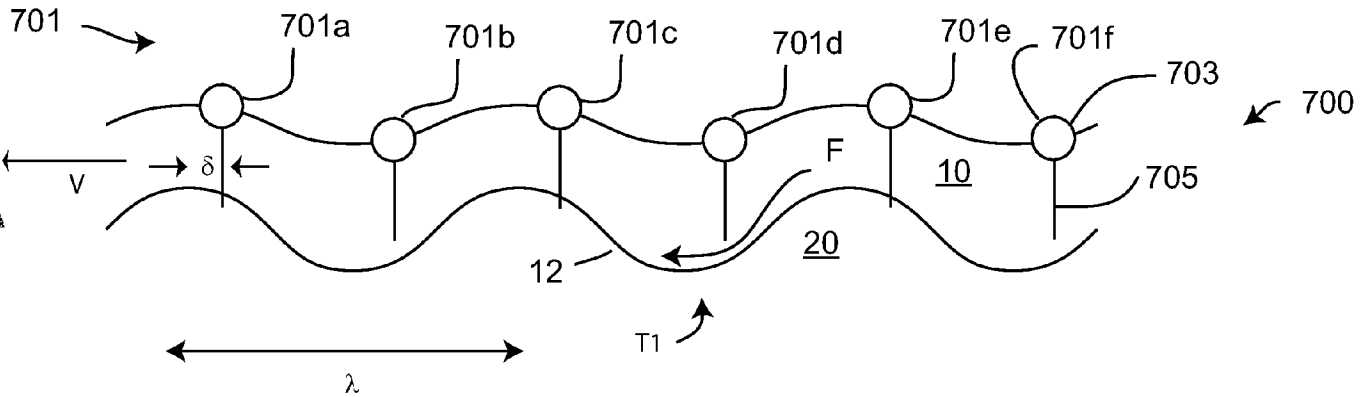
FIGS. 7A, 7B, and 7C are side views illustrating a fourth embodiment of an apparatus for transporting a fluid.
Figure 7B:
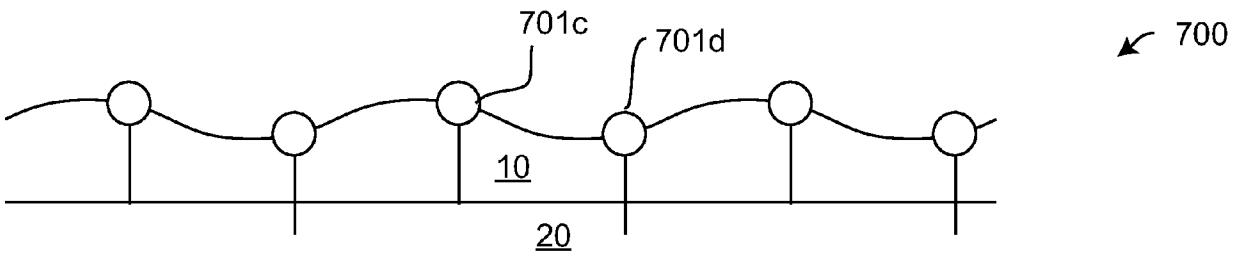
Figure 7C:
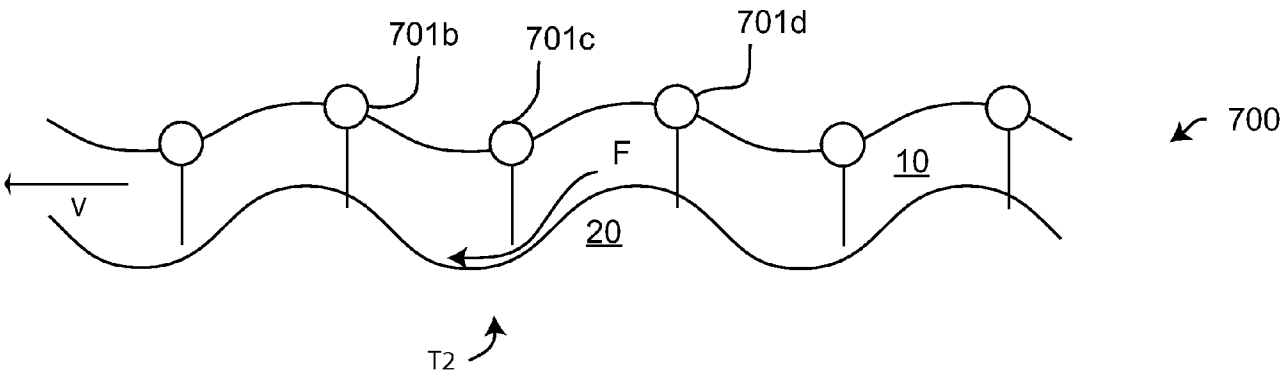

FIGS. 7A, 7B, and 7C are side views illustrating a fourth embodiment of a channel 700 for transporting a fluid, which is generally similar to channel 100, 400, 410, or 600, except as explicitly noted. FIG. 7A is at time t=0, FIG. 7B at time t=T/4 and FIG. 7C at time t=T/2 of period T.

Channel 700 contains a plurality of identical barriers 701, several of which are individually labeled 701*a-f*. Each barrier 701 floats on surface 12 of fluid 10. Thus, for example, each barrier 701 includes a float 703 and a gate 705 that extends along width W and into fluid 10. Barriers 701 may be tethered to channel 700 or ride on rails attached to the conduit to permit them to move longitudinally in an oscillatory motion. Alternatively, barriers 701 may ride on rails attached to the conduit to permit them to move vertically.

With the height of gate 705 chosen to be within the range of the depth of fluid 10, the gate alternatively protrudes into fluid 20 and withdraws from the fluid, permitting fluid 10 to move generally in the flow direction, but having hindered backflow.

Individual barriers 701 are located at half-wave locations, spaced by l/2, for example. Further, barriers 701 are located at positions slightly "upstream" of the peak/trough location by a distance δ.

The operation of channel 700 is similar to that of channel 600. As fluid 10 oscillates between curved and flat, as indicated in FIGS. 7A-7C, surface 12 moves below barriers 601, permitting the fluid to flow, as indicated by arrow F during each half cycle, providing a net flow of fluid 10. Specifically, due to the gap g between surface 12 and barrier 601, fluid 10 may collect in troughs of surface 12 between alternate barriers 601. Thus, for example, FIG. 7A shows that some barriers, such as barriers 701*a*, 701*c*, and 701*e*, extend through fluid 10 and thus prevent any net flow past these barriers. Some barriers, such as barriers 701*b*, 701*d*, and 701*f*, have some space below the barrier through which fluid 10 may flow. As a result of the gap g, some net flow F of fluid 10 may flow and collect in a trough, such as trough T1.

As surface 12 recedes, as in FIG. 7B, there may be some backflow of fluid 10. In FIG. 7C, fluid 20 crests and contacts near other alternate floating barriers 701, causing a net flow of fluid 10. Thus, for example, the fluid in trough T1 may advance to the downstream trough T2. The repetition of this motion induces an average flow of fluid 10.

FIG. 7D is a side view illustrating an alternative fourth embodiment of an apparatus including a channel 700 for transporting a fluid, which is generally similar to channel 100, 400, 600 or 700, as discussed above, except as explicitly noted.

In channel 700 a plurality of identical barriers 710, several of which are individually labeled 710*a-f*. Each barrier 710 floats on surface 12 of fluid 10 and is generally similar to barrier 710, and also includes a hinge 706, a hinged bottom portion 707 extending below gate 705. Portion 707 is affected by forces of fluid 10, but is hinged to gate 705 to swing in one direction only, thus permitting flow only in a downstream direction. As an example, portions 710*a*, 710*c*, and 710*e* illustrate portion 707 as aligned with gate 705, and portions 710*b*, 710*d*, and 710*f* illustrate portion 707 pointed downstream. Portions 707 faceplate the flow in the downstream direction.

FIG. 8 is a side view illustrating a fifth embodiment of a channel 800 for providing a change in height of the fluids. Channel 800 includes three portions: channel 801 having a bottom 105*a*, channel 803, and channel 805 having a bottom 105*b*. Channels 801 and 805 are, in general, similar to channels 100, 400, or 600. As shown in FIG. 8, channels 801 and 805 each have a depth of D, and bottom 105*b* of channel 105 is a higher level than bottom 105*a* of channel 801 by a height H1. Channel 803 is a transition channel that raises the level of the fluid by the height H. The height H1 may be, for example from 20 feet to 30 feet.

FIGS. 9A, 9B, 9C, and 9D are four sequential side views illustrating an embodiment of channel 803 at four sequential quarter intervals of the oscillation of fluid 10 and 20. Channel 803 includes several portions, shown for illustrations as gates 910, 920, 930, and 940. Each gate extends the width of the channel and floats on fluid 20. Gates 910, 920, 930, and 940 may be hollow or solid, but in general are buoyant with respect to fluid 20 and approximately neutral with respect to fluid 10.

Gates 910, 920, 930, and 940 may move independently in a vertical direction, with corresponding bottoms 913, 923, 933, and 943 shown as being near the average level of surface 12. As surface 12 oscillates, gates 910, 920, 930, and 940 move up and down. The width of the gate is one half a wavelength λ, such that adjacent gates move up and down past each other, as indicated in FIGS. 9A-D.

The top of each gate 910, 920, 930, and 940 is slopped downwards in the direction of flow, as indicated by top 911, 921, 931, and 941. As gates 910, 920, 930, and 940 rises and fall, fluid 10 is collected on tops 911, 921, 931, and 941 and urged in the flow direction. Thus, for example, FIGS. 9B and 9D show the fluid surface 11*a* on the low side of channel 801 and fluid surface 11*b* on the high side of channel 805. FIGS. 9A-9D also show volumes of fluid 10, as 10*a* and 10*b*, which are moved in the flow direction as gates 910, 920, 930, and 940 moves up and down. As one illustrative example of motion of the fluid, FIG. 9A shows a volume 10*a* on the top of gate 930. As gate 930 is displaced upwards, the volume 10*a* flows on top of gate 920, as shown in FIG. 9B. During this time, a volume 10*b* moves onto the end gate: gate 940. Next, the motion raises the level of volumes 10*a* and 10*b*, as shown in FIG. 9C. Next, the gates are positioned to allow volumes 10*a* and 10*b* to move again—with volume 10*a* flowing into the higher level conduit 805 and volume 10*b* moving on top of gate 930. As the oscillations continue, fluid 10 is thus moved to higher level.

It should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

We claim:

1. An apparatus adapted to accept two or more fluids, where the two or more fluids includes a first fluid and a second fluid that is more dense than the first fluid, and where the first fluid is transported in a flow direction, said apparatus comprising:

a channel to accept the two or more fluids;

a first means to produce periodic standing waves in the accepted first fluid along the flow direction; and a second means to induce a net motion of the first fluid in the flow direction.

2. The apparatus of claim 1, where the standing waves has a wavelength, where said first means includes a plurality of oscillatory devices, and where adjacent oscillatory devices are separated by a distance of the wavelength.

3. The apparatus of claim 2, where said oscillatory device includes a device to periodically displace an accepted second fluid.

4. The apparatus of claim 2, where said oscillatory device includes an element having a surface in contact with an accepted second fluid, and where said oscillatory device periodically moves said surface in a direction perpendicular to the surface.

5. The apparatus of claim 1, where said second means includes means to provide a force on the accepted first fluid in the flow direction.

6. The apparatus of claim 1, where said means to provide a force includes one or more devices to direct a flow of air onto the accepted fluid.

7. The apparatus of claim 1, where said means to provide a force includes one or more devices having a surface that contacts an upper surface of the first fluid.

8. The apparatus of claim 1, where said second means includes means to prevent the accepted first fluid from flowing in a direction counter to the flow direction.

9. The apparatus of claim 8, where said second means includes means includes a plurality of equally spaced barriers extending the width of the channel and extending into the accepted first fluid.

10. The apparatus of claim 9, where said plurality of barriers are fixed to the channel.

11. The apparatus of claim 10, where said plurality of barriers float on an accepted fluid.

12. The apparatus of claim 1, where an accepted first fluid has a periodic minimum depth and a periodic maximum depth, and where said second means includes one or more vertical elements that float on the accepted first fluid and extend into the accepted first fluid by a distance that is greater than the minimum depth and less than the maximum depth.

13. The apparatus of claim 1, where said two or more fluids is three or more fluids, and where one of said three or more fluids is a third fluid that is less dense than the first fluid.

14. The apparatus of claim 1, where said channel is a first channel, further comprising a second channel having fluids at a level higher that said first channel, and a transition between said first channel and said second channel comprising a plurality of floating gates adapted for raising the fluid level.

15. The apparatus of claim 1, where said first fluid includes a liquid.

16. The apparatus of claim 15, where said first fluid includes particles.

17. The apparatus of claim 16, where said particles have a density that is equal to the density of the first fluid.

18. The apparatus of claim 16, where said particles have a density that is less than to the density of the first fluid.

19. The apparatus of claim 16, where said particles include encapsulated fluids or devices.

20. A method to accept one or more fluids and transport a first fluid of the one or more accepted fluids in a flow direction, said method comprising:

accepting one or more fluids in a channel;

imparting a periodic standing wave to the accepted fluids, where said standing wave is generally aligned with the flow direction; and providing means to inhibit the flow of the accepted first fluid in a direction counter to said flow direction.

21. The method of claim 20, where said imparting includes inducing periodic motion to the first fluid.

22. The method of claim 20, where said imparting includes inducing periodic motion in a plurality of devices in contact with the accepted fluid.

23. The method of claim 20, where said providing includes providing a force on the accepted first fluid in the flow direction.

24. The method of claim 20, where said providing includes providing a plurality of floating elements that inhibit the flow of the accepted first fluid in a direction counter to said flow direction.

25. The method of claim 20, where said accepting accepts two or more fluids including a second fluid that is more dense that the first fluid.

26. The method of claim 20, where said first fluid includes a liquid.

27. The method of claim 20, where said first fluid includes particles.

28. The method of claim 27, where said particles have a density that is equal to the density of the first fluid.

29. The method of claim 27, where said particles have a density that is less than to the density of the first fluid.

30. The method of claim 27, where said particles include encapsulated fluids or devices.

* * * * *

UNITED STATES PATENT AND TRADEMARK OFFICE

CERTIFICATE OF CORRECTION

PATENT NO. : 8,776,830 B2
APPLICATION NO. : 13/156741
DATED : July 15, 2014
INVENTOR(S) : Walter Chen and C. K. Hari Dharan It is certified that error appears in the above-identified patent and that said Letters Patent is hereby corrected as shown below:

In the Claims

Column 7, line 45, cancel the text beginning with "9. The apparatus" to and ending "first fluid." in Column 7, line 48, and insert the following claim:

--9. The apparatus of Claim 8, where said second means includes a plurality of equally spaced barriers extending the width of the channel and extending into the accepted first fluid.--

Signed and Sealed this
Seventh Day of October, 2014

Michelle K. Lee

Michelle K. Lee
*Deputy Director of the United States Patent and Trademark Office*